US007085391B1

(12) United States Patent
Yamaya

(10) Patent No.: US 7,085,391 B1
(45) Date of Patent: Aug. 1, 2006

(54) PICKUP APPARATUS OF PIANO

(76) Inventor: Kiyohiko Yamaya, Maple Shonandai #306, 6-3-2 Shonandai, Fujisawa-shi, Kanagawa-ken (JP)

( * ) Notice: Subject to any disclaimer, the term of this patent is extended or adjusted under 35 U.S.C. 154(b) by 0 days.

(21) Appl. No.: 09/472,818

(22) Filed: Dec. 28, 1999

(30) Foreign Application Priority Data

Apr. 30, 1999 (JP) ..... 11-123828

(51) Int. Cl.
*G10H 1/00* (2006.01)

(52) U.S. Cl. ..... 381/118

(58) Field of Classification Search ..... 381/118, 381/152, 162, 114, 173, 366; 84/727, 731, 84/184, 734, 730; 24/453; 411/80.5; 984/301, 984/303, 344, 362, 364, 370, 373
See application file for complete search history.

(56) References Cited

U.S. PATENT DOCUMENTS 1,994,919 A * 3/1935 Nelson ..... 84/727
3,725,561 A * 4/1973 Paul ..... 84/726
3,869,952 A * 3/1975 Rowe ..... 84/727
4,022,100 A * 5/1977 Johnson ..... 411/80.5
4,058,045 A * 11/1977 Jennings et al. ..... 84/731
4,084,473 A * 4/1978 Kitashima et al. ..... 84/731
4,155,284 A * 5/1979 Graves ..... 84/187
4,242,937 A * 1/1981 Pozar ..... 84/725
4,290,331 A * 9/1981 Izdebski ..... 84/731
4,377,102 A * 3/1983 Mayerjak ..... 84/184
5,109,747 A * 5/1992 Spuler ..... 84/731
5,134,920 A * 8/1992 Clark ..... 84/730
6,087,574 A * 7/2000 Kitashima et al. ..... 84/423 R

* cited by examiner

*Primary Examiner*—Xu Mei
*Assistant Examiner*—Andrew Graham
(74) *Attorney, Agent, or Firm*—Reed Smith LLP; Stanley P. Fisher, Esq.; Juan Carlos A. Marquez, Esq.

(57) ABSTRACT

There is provided a pickup apparatus for reliably and correctly picking up piano sound by rigidly connecting a sound source member such as a sound board of a piano body, with a stationary member such as a cast-iron plate with use of a pickup apparatus body of the invention to one another so as to pickup the generated vibration force. The pickup apparatus can also be attached to or detached from an existing piano easily and at low cost, and the piano is not damaged when the pickup apparatus is attached to and detached from the piano. Further, noise component which is unnecessary for the piano sound can be eliminated by providing the pickup apparatus body of the present invention with a mechanical vibration filter.

11 Claims, 19 Drawing Sheets

PICKUP APPARATUS OF PIANO

BACKGROUND OF THE INVENTION

1. Field of the Invention

The present invention relates to a pickup apparatus of a piano which is mounted to a piano for taking out piano sound as electric signal.

Since pianos have a history of some hundreds years and are loved on a worldwide basis, names of various parts of a piano are different depending upon countries, fanciers and makers in many cases. Therefore, it is necessary to define the names of various members of piano used in this specification.

The term "piano body (A)" used in this specification means both "grand piano" shown in FIGS. 1 and 2, and "vertical piano" shown in FIG. 3. That is, the term "piano body (A)" is used for both the pianos.

The term "stationary member (B)" used in this specification generally means, as shown in FIGS. 1 to 3, cast-iron plate (b1), pin block (b2) for stopping an end of strung string, case (a1), brace (b4), inner rim (b5), outer rim (b6), back post (b3) of the vertical piano body (A), accessory thereof, and shape of the accessory.

The term "sound source member (C)" used in this specification generally means, as shown in FIGS. 1 to 3, sound board (c1) used in a general piano, rib (c2) adhered to the sound board (c1), bridge (c3) adhered to the sound board, bridge pin (c4) of the bridge (c3) adhered to the sound board (c1), and string (c5) adhered to the sound board (c1) and strung such as to be in contact with the bridge (c3).

The term "pickup apparatus body (D)" used in this specification generally means sensor member (1) having first contact member (2) which is in contact with the stationary member (B) and second contact member (3) which is in contact with the sound source member (C) such as the sound board (c1) of the piano body (A).

2. Description of the Prior Art

There is a known pickup apparatus of a piano having a structure for picking up vibration acceleration of a member which serves as a sound source such as a sound board by adhering a vibration acceleration pickup which converts vibration acceleration into electric signal and outputs the same to a member which serves as the sound source such as the sound board of the piano body.

There has already been proposed to drive a loudspeaker by converting vibration of a sound board in a piano into an electric signal and amplifying the electric signal. For example, as disclosed in specification of U.S. Pat. No. 4,058,045, when vibration of the sound board is converted into an electric signal, a pickup comprising a piezoelectric element provided at its opposite surfaces with electrodes is held by holders or housings. One of the holders is brought into contact with the sound board of the piano, and the other one of the holders is connected to a backup plate which serves as a mass provided on an upright of the piano through a spring. A typical acceleration pickup is constituted by the piezoelectric element and the mass. This acceleration pickup is brought into contact with the sound board of the piano, and piano sound is picked up by picking up the vibration acceleration.

However, it is known that a plate-like vibration plate such as the sound board of the piano body has complicated vibration modes. When such a plate-like vibration plate is vibrating at a certain mode, there exist some points in this plate-like vibration plate at which the vibration acceleration substantially stops and becomes substantially zero, and these points are generally called "nodes".

Further, a point between a node and a node in the plate-like vibration plate at which the vibration acceleration rises to a maximum value is generally called an "antinode". These nodes and antinodes move on the vibration plate by vibration frequency of the vibration plate to form complicated vibration modes.

Therefore, in the case of a pickup of a piano having a structure of picking up the piano sound by picking up the vibration acceleration at a certain point on the sound board of the piano, the point in which the pick up is mounted becomes near to a node or to an antinode of the vibration mode by the frequency at which the sound board vibrates, and the vibration at the point becomes unstable in vibration mode. Therefore, at the frequency at which the point becomes near to a node, the vibration acceleration at that point is small and thus, the output of the pickup is small, and at the frequency at which the point becomes near to an antinode, the vibration acceleration at that point is great. Thus, the output of the pickup is great, and the output of the pickup becomes great or small (increased or decreased) depending upon the frequency of the vibration of the sound board.

For this reason, in the case of the acceleration pickup system, the pickup sound is increased or decreased depending upon the frequency, and it is difficult to output the piano sound with high fidelity.

In the case of a pickup of a piano having a mounting structure in which the acceleration pickup or the like is adhered to the piano using paste, adhesive, double-faced tape, adhesive tape or the like, if the pickup is not adhered completely, there is a problem that tone quality of picked up piano sound is changed or the distortion is included in the sound. Further, if the pickup is adhered to the piano completely and then, the pickup is detached later, varnish or paint on a portion of the piano where the pickup was mounted is peeled off and the piano is damaged. Especially when the piano is made of wood, there is a problem that the wood itself of the piano may be peeled off when the pickup is detached, and the piano is seriously damaged, which is inconvenient.

Further, in a pickup apparatus having a structure in which the acceleration pickup is brought into contact with a sound board of the piano by a spring, a mechanical resonator is constituted by the pickup and the spring. The acceleration of the pickup is liable to be amplified at the resonance frequency and as a result, a peak is generated in the output, and it is difficult to output the piano sound with high fidelity.

Further, in the case of this pick up, the pickup is pushed against the sound board by a force of the spring. Therefore, the distance between the sound board and the upright is largely varied depending upon the kind of piano and mounting piano even if the same piano is used and thus, it is difficult to adjust the pushing force of the pickup against the sound board to an appropriate value.

For example, if the distance between the sound board and the upright is excessively great, the compression force of the spring, i.e., the pushing force of the pickup against the sound board is insufficient, and when the vibration of the sound board is great, the pickup floats up from the sound board, and undesirable distortion is generated in the sound. To the contrary, if the distance between the sound board and the upright is excessively small, the compression force of the spring, i.e., the pushing force of the pickup against the sound board becomes excessively great, and when the pickup is pushed and mounted between the sound board and the upright, the pickup or the spring is ground against the sound board and the upright with strong force, and the sound board or the upright may therefore be damaged, or the sound board may be excessively deformed, and the piano sound can not be produced with high fidelity.

SUMMARY OF THE INVENTION

One of the objects of the present invention is to provide a pickup apparatus capable of playing piano sound with high fidelity.

Another object of the invention is to provide a pickup apparatus for reliably and correctly picking up piano sound by rigidly connecting a sound source member such as a sound board of a piano body, with a stationary member such as a cast-iron plate with the use of a pickup apparatus body of the invention so as to pickup the generated vibration force.

Another object of the invention is to provide a pickup apparatus capable of easily attaching to or detaching from a piano.

Another object of the invention is to provide a pickup apparatus which is not easily damaged when the pickup apparatus is attached to and detached from a piano.

Another object of the invention is to provide a pickup apparatus having a mechanical vibration filter which eliminates noise components which are unnecessary for piano sound.

According to the present invention, there is provided a pickup apparatus of a piano, comprising: a sensor member having a first contact member which is in contact with a stationary member such as a cast-iron plate of a piano body and a second contact member which is in contact with a sound source member such as a sound board of the piano body; and a length-adjusting mechanism provided on one or both of the first and second contact members, wherein a vibration force applied from the stationary member and the sound source member is converted into an electric signal and output.

By sandwiching the rigid pickup apparatus of the present invention between the sound source member such as a sound board and the stationary member such as a cast-iron plate while applying appropriate preload, the vibration of the sound source member at that point is restrained, a node of the vibration mode whose position is fixed at that point is newly created and at the same time, a force for restraining the vibration is applied to the stationary member through the rigid pickup. Therefore, the vibration force is applied to the pickup, and by converting this vibration force into electric signal and outputting the same, it is possible to always pickup at the point of the node of the vibration mode, and if the sound board is vibrated at any frequency, it is possible to restrain the increase or decrease of the output of the pickup caused by the vibration mode of the sound board to a minimum value, and it is possible to stably output the piano sound with high fidelity.

Further, by applying appropriate preload between the stationary member and portions contacting with a rib adhered to the sound board, a bridge, a bridge pin provided on the bridge, and a bridge of a string so as to sandwich the rigid pickup apparatus of the present invention, the same effect can be obtained, and it is possible to stably output the piano sound with high fidelity.

The present invention should not be limited to the above-described structure and the working effect obtained therefrom, the invention also includes other structural characteristics and excellent working effect associated with the characteristics, and they fall within the patent claims of the present invention, and they will be made clear in the following embodiments and embodiment claims associated thereto.

DETAILED DESCRIPTION OF THE INVENTION

Figure 1:
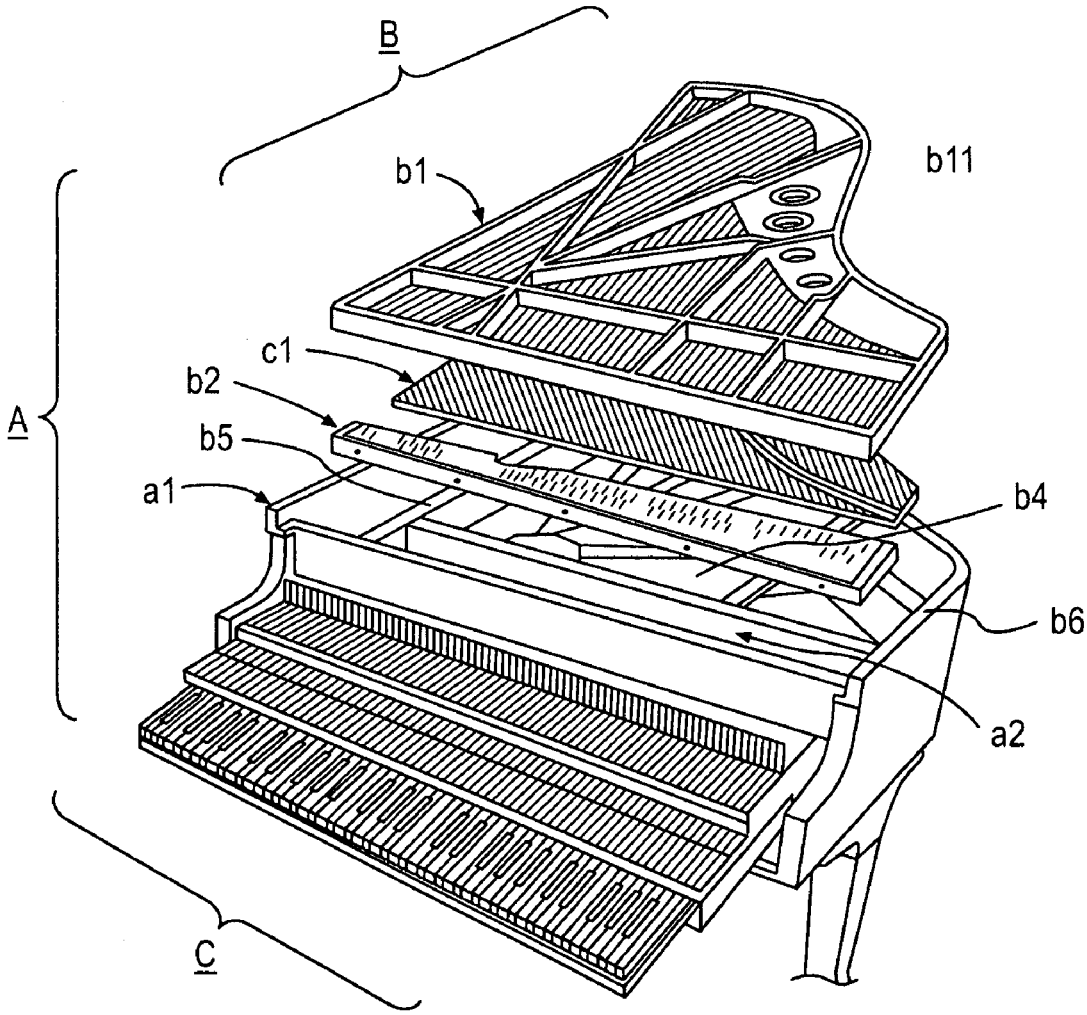
FIG. 1 is a perspective view of a grand piano.
Figure 2:
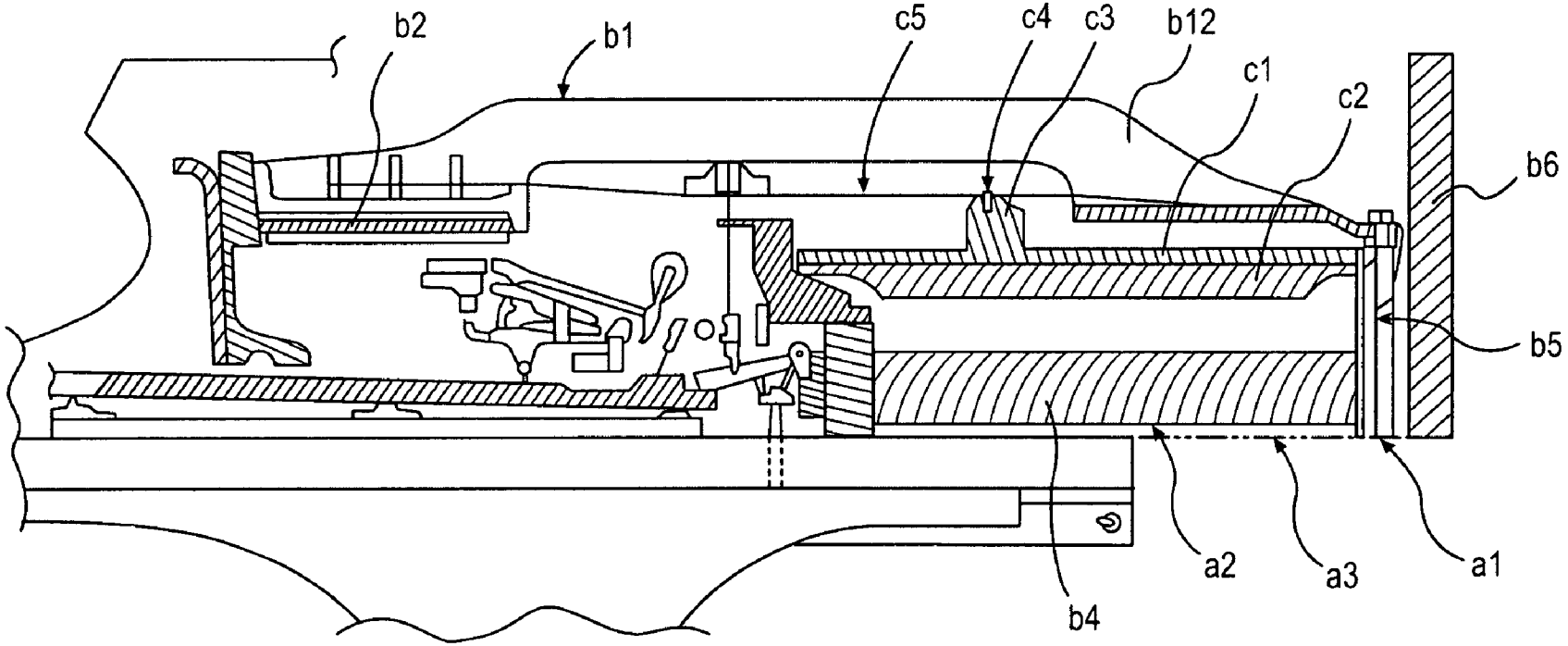
FIG. 2 is a vertical sectional view of the grand piano.
Figure 3:
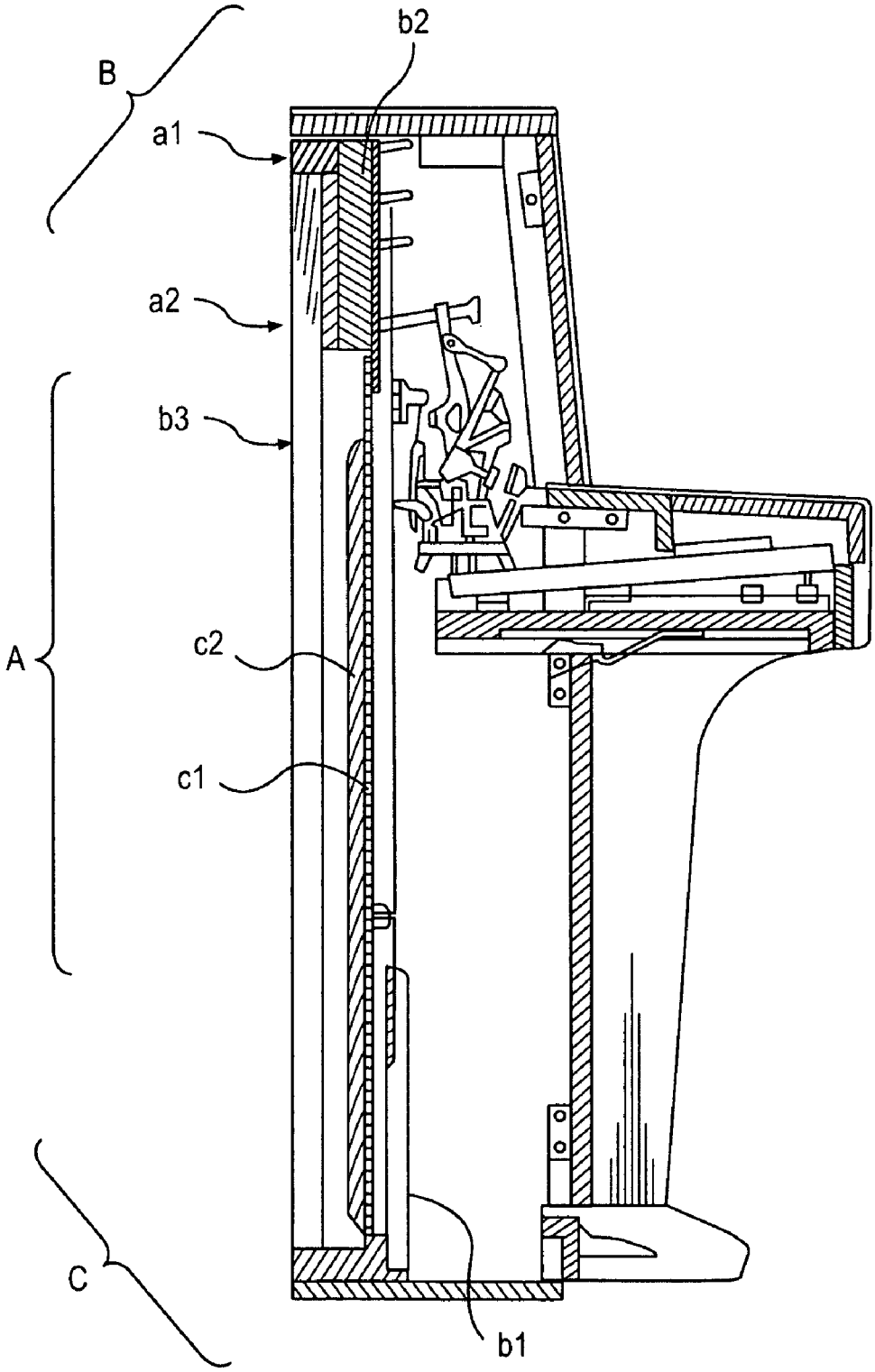
FIG. 3 is a vertical sectional view of a vertical piano.

For explaining embodiments of the present invention, FIGS. 1 and 2 show a grand piano, and FIG. 3 shows a typical vertical piano. Substantially common parts of the grand piano and the vertical piano are represented by the same symbols even if the shapes or mounting places thereof are different.

In the drawings, (A) represents a piano body, (a1) represents a case constituting the piano body (A), (a2) represents a beam member for supporting the case (a1), and (a3) represents various reinforcing members for supporting the beam member (a2).

In addition to the various constituent elements of the piano body (A), (b1) represents a cast-iron plate for stringing strings mounted to the case (a1), and the cast-iron plate (b1) comprises holes (b11) for enhancing transparent sound, and a reinforcing arm (b12).

Further, (b2) represents a pin block for securing ends of the strung strings, and (b3) represents a back post in the vertical piano.

FIGS. 4 to 7 show embodiments in which a pickup apparatus of the present invention is mounted between the sound board (c1) and the cast-iron plate (b1), and a through hole (b11) of the cast-iron plate (b1) is utilized.

Figure 4:
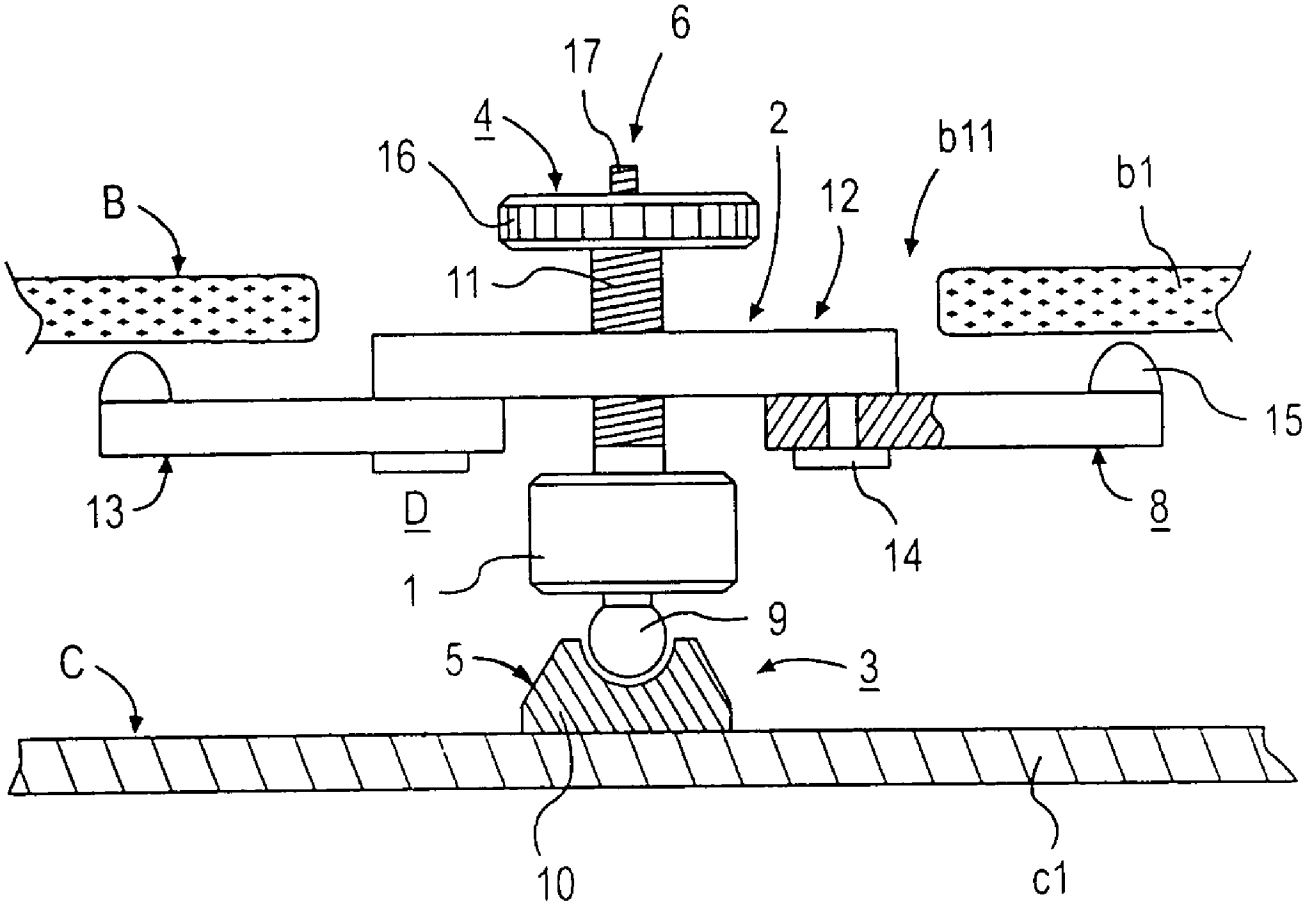
FIG. 4 is a partially cut-away front explanatory view of a first embodiment.

In FIG. 4, (D) represents a pickup apparatus body which is placed on the vertically center axis of the through hole (b11). A lower surface of the pickup apparatus body (D) is continuously formed with a second contact member (3). More specifically, the lower surface is formed at its central portion with a sensor member (1) whose terminal end has a downward projecting spherical body (9). A supporting body (1) is placed and fixed on the sound board (c1) immediately below the spherical body (9), and the spherical body is fitted to the supporting body (10). As a result, the pickup apparatus body (D) acts as an angle adjusting mechanism (5) capable of freely swinging in the horizontal direction around this supporting point as a fulcrum.

An upper portion of the pickup apparatus body (D) is threaded into a long screw (11), and the long screw (11) threadedly passes through a center portion of a horizontal main arm (12) having a diameter smaller than that of the through hole (b11). Reference numeral (13) represents a plurality of sub-arms whose inner ends are screwed (14) to the outer sides of the main arm (12) and disposed in the radial directions. The outer ends of the sub-arms (13) are in contact with a back surface of the cast-iron plate (b1) located outside of the through hole (b 11) through contact members (15).

Reference numeral (16) represents a rotation knob fixed to an upper end of the sensor member (1), and (17) represents an output connector whose terminal end is electrically connected to the sensor member (1).

If the rotation knob (16) is rotated, the long screw (11) is associatively rotated to rise the main arm (12). As a result, the sub-arms (13) push up the back surface of the cast-iron plate (b1) through the contact members (15). That is, the sensor member (1) is allowed to be interposed between the sound board (c1) and the cast-iron plate (b1) through the supporting body (10) and the sub-arms (13), respectively, and the vibration of the sound board (c1) is introduced through the supporting body (10) and the spherical body (9) and converted into a signal, and output from the output connector (17).

That is, the rotation knob (16) is rotated leftward as viewed in the drawings so that the sensor member (1) brought into a state in which the sensor member (1) approaches the main arm (12) closest. Next, the two sub-arms (13) mounted to the opposite ends of the main arm (12) are folded so that the tip ends of the sub-arms (13) come closest to the main arm (12). The entire pickup apparatus body (D) is inserted to the hole (b11) of the cast-iron plate (b11), the contact member of the sound board (c1) of the pickup apparatus body (D) is brought into contact with the sound board, and all of the sub-arms (13) are moved such that the contact members (15) are placed between the cast-iron plate (b1) and the sound board (c1). Then, the rotation knob (16) is rotated rightward so that the contact members (15) are brought into contact with the back surface of the cast-iron plate (b1), and the pickup apparatus body (D) is sandwiched between the cast-iron plate (b1) and the sound board with appropriate force. Then, an output cable (not shown) is connected to the output connector (17), and the mounting operation is completed.

Here, sound quality of the sound output from the pickup is checked by hearing the same, and the sandwiching force of the pickup is adjusted if necessary. By carrying out the above-described procedure in the reverse order, it is possible to easily mount and demount the pickup apparatus body (D).

Figure 5:
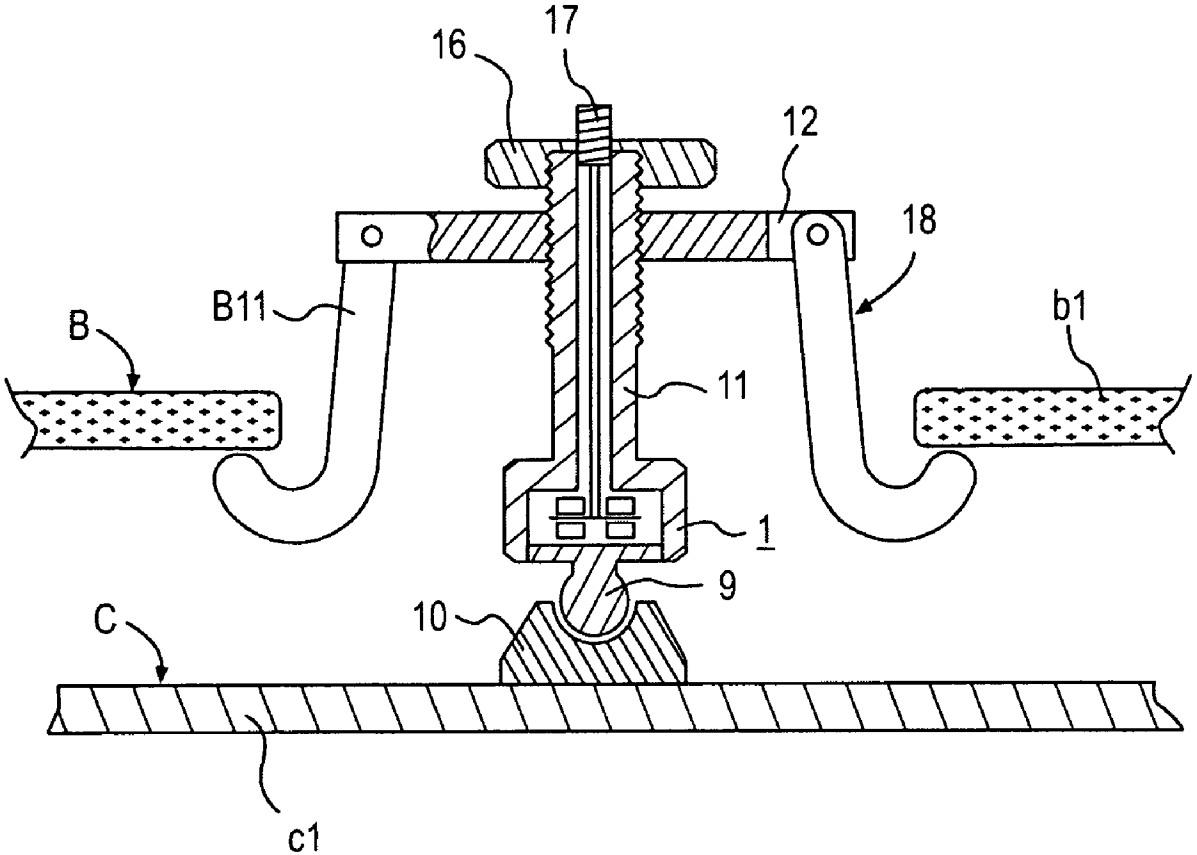
FIG. 5 is a partially cut-away front explanatory view of a second embodiment.

Next, an embodiment shown in FIG. 5 will be explained while representing the same parts with the same symbols as those in the previous embodiment. The main arm (12) is on the vertically central axis of the through hole (b11) in the cast-iron plate (b1), and the main arm (12) is horizontally placed above the through hole (b11). Upper ends of J-shaped and reversed J-shaped sub-arms (18) are pivotally mounted to the opposite ends of the main arm (12), and other ends of the sub-arms (18) are located outside of the through hole (b11) and in contact with the back surface of the cast-iron plate (b1).

The rotation knob (16) is rotated in the same manner as that of the previous embodiment, so that the sensor member (1) is allowed to be tightly interposed between the sound board (c1) and the cast-iron plate (b1).

Figure 6:
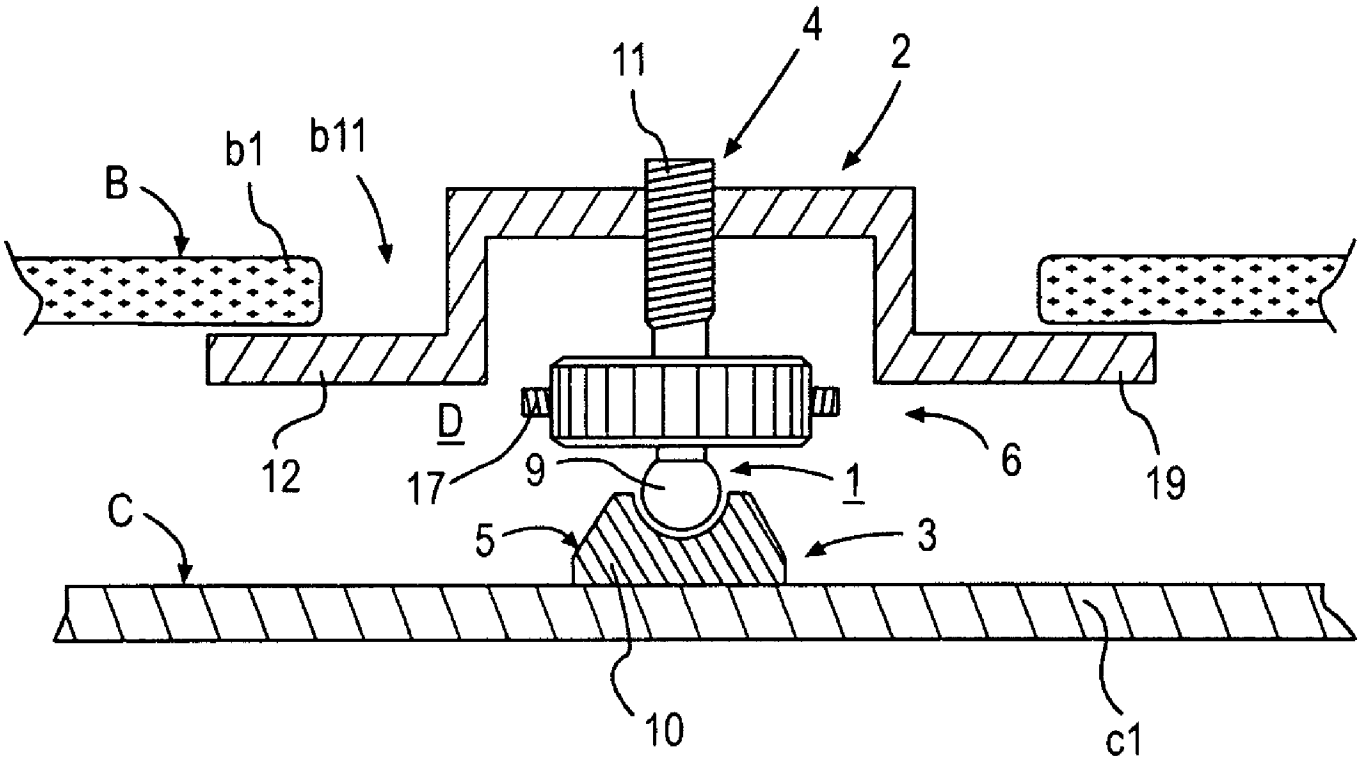
FIG. 6 is a partially cut-away front explanatory view of a third embodiment.
Figure 7:
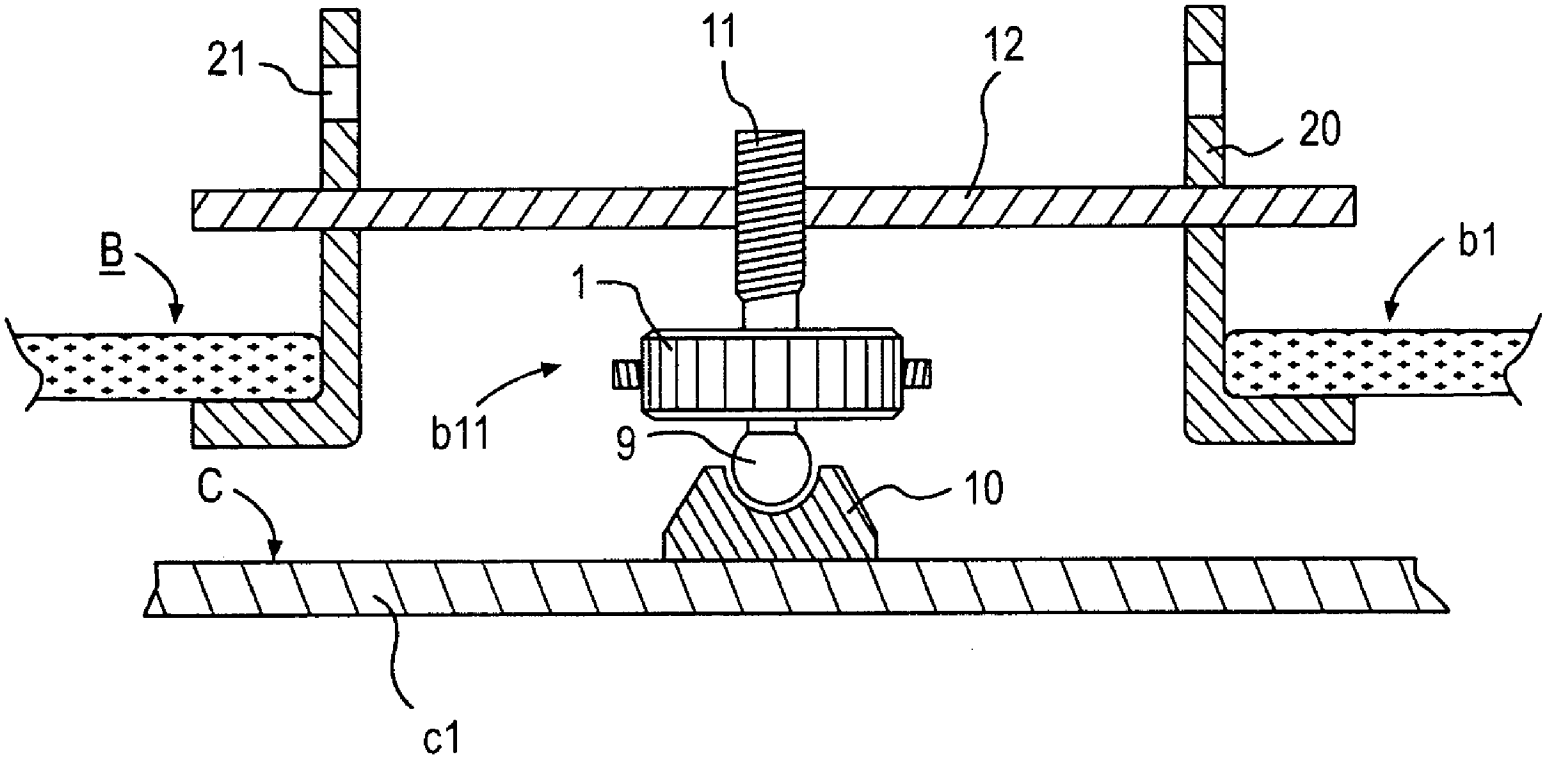
FIG. 7 is a partially cut-away front explanatory view of a fourth embodiment.

FIGS. 6 and 7 show modifications of the above-described main arm (12). That is, the main arm (12) shown in FIG. 6 is formed into a horizontal convex shape. The long screw (11) threadedly passes through a central portion of the main arm (12), and opposite shoulder portions (19) are located outside a through hole (c11) and in contact with the back surface of the cast-iron plate (b1).

If the sensor member (1) or the main arm (12) is rotated, the sensor member (1) is allowed to tightly be interposed between the sound board (c1) the cast-iron plate (b1). FIGS. 6 to 9 showing this embodiment, and in FIGS. 10 to 19 showing other embodiments show a case in which the output connector (17) of an electric output connector member (6) is directed mounted to the sensor member (1).

The pickup apparatus body (D) having a first contact member (2) and a second contact member (3) is provided with a length adjusting mechanism (4), and the pickup apparatus body (D) is sandwiched in a gap between the cast-iron plate (b1) which is a stationary member (b) and the sound board (c1) which is the sound source member (C) and thus, the pickup apparatus body (D) is provided with a function as the angle adjusting mechanism (5) which can adjust the contacting angle of the cast-iron plate (b1).

Further, since the cast iron-plate (b1) is extremely hard, even if it is brought into contact with the first contact member (2), the cast-iron plate (b1) is not deformed or a contacting trace does not remain. However, if the stationary member (B) is made of wood, the contacting trace may remain in such wood and therefore, it is important to select appropriate embodiments which will be described later.

In an embodiment shown in FIG. 7, a member corresponding to the above-described main arm (12) is a flat horizontal metal plate. (20) represents a pair of L-shaped sub-arms, a vertical portion of each of the sub-arms (20) is formed with a single or a plurality of through grooves (21), and opposite ends of the main arm (12) are fitted in the through grooves (21).

Horizontal upper surfaces of the sub-arms (20) are in contact with the back surface of the cast-iron plate (b1). If the sensor member (1), the long screw (11), or the main arm (12) is rotated, the pickup apparatus body (D) is allowed to be tightly interposed between the sound board (c1) and the cast-iron plate (b1).

In the above embodiment, the through hole (b11) of the cast-iron plate (b1) is utilized. Off course, the through hole (b11) may not be utilized, and FIG. 8 and subsequent drawings show such an example.

Figure 8:
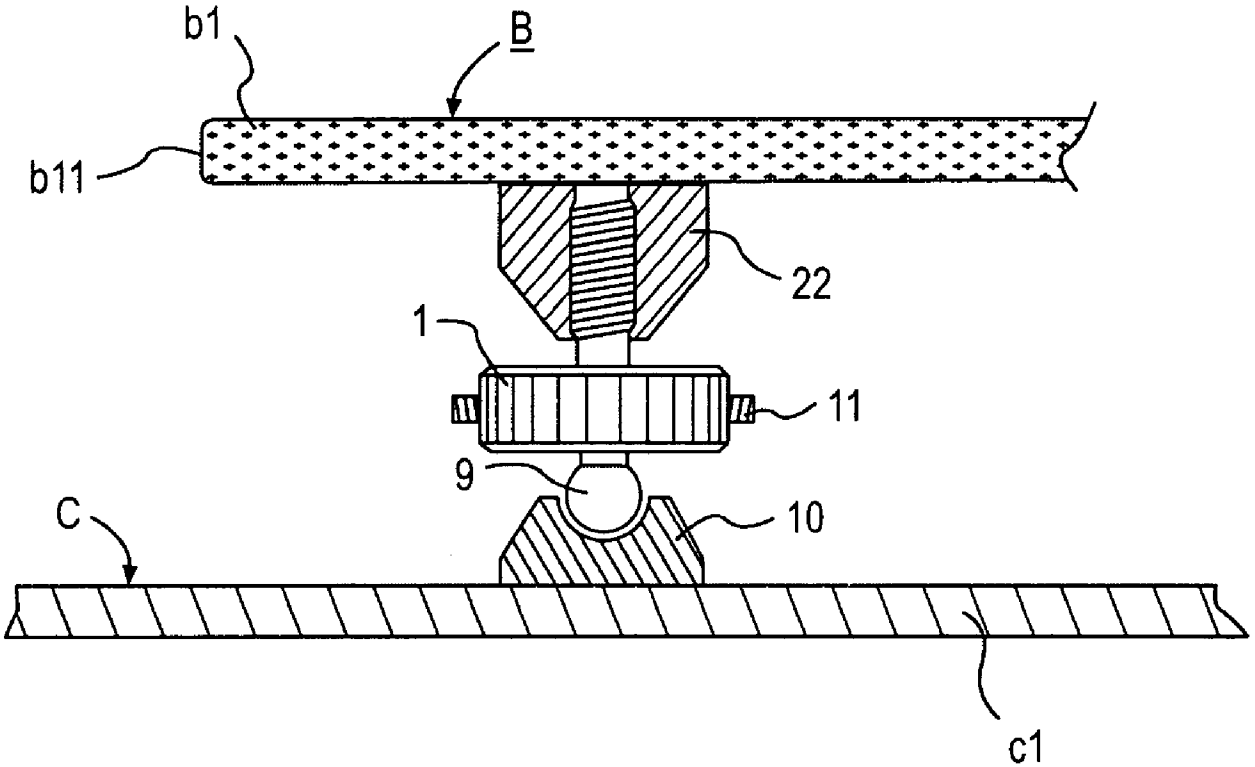
FIG. 8 is a partially cut-away front explanatory view of a fifth embodiment.

That is, in FIG. 8, (22) represents a nut-like rotation base which is threadedly engaged with the long screw (11), and by rotating the base (22), the pickup apparatus body (D)

having the sensor member (1) can be allowed to be tightly interposed between sound board (c1) and the cast-iron plate (b11).

In any of the above embodiments, the supporting body (10) is placed on the sound board (c1), and the spherical body (9) of the sensor member (1) is fitted to the supporting body (10). As described above, this is the angle adjusting mechanism (5) of the piano contacting surface angle. This mechanism may not be provided off course.

Figure 9:
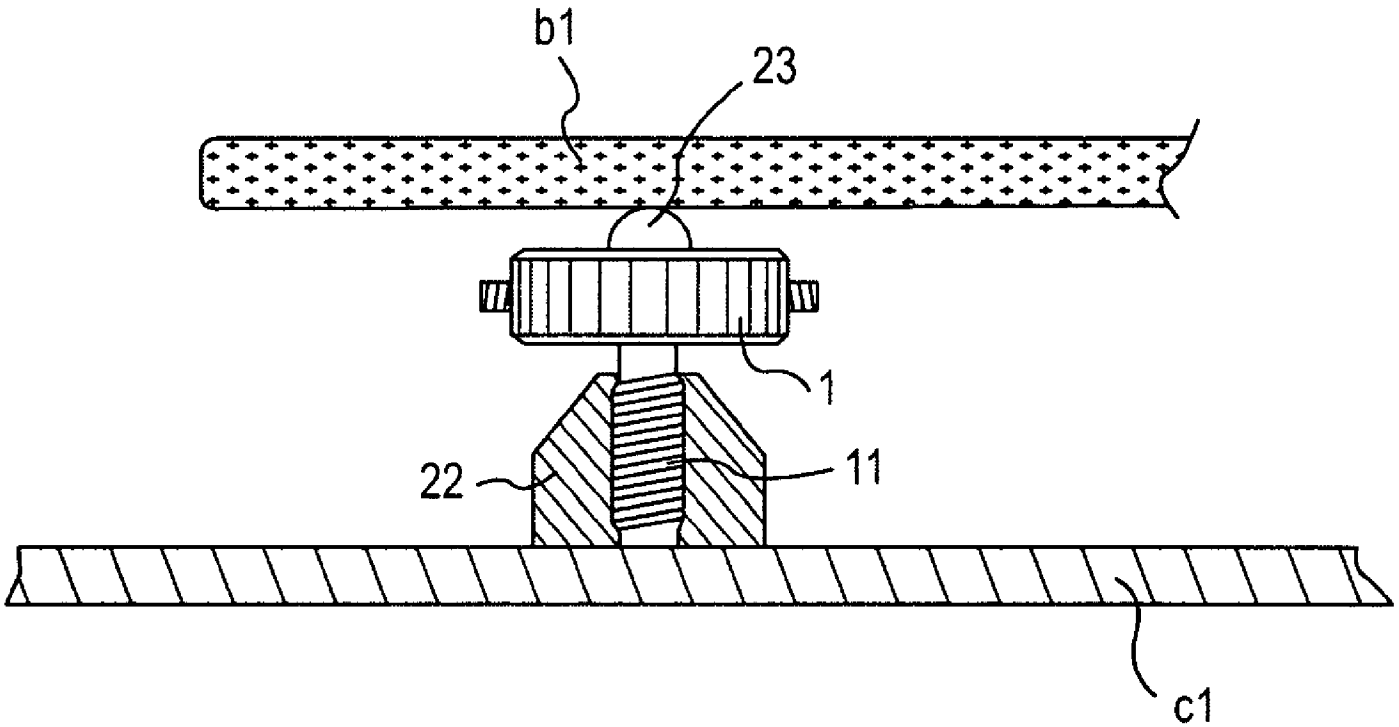
FIG. 9 is a partially cut-away front explanatory view of a sixth embodiment.

That is, in FIG. 9, the long screw (11) in the embodiment shown in FIG. 8 is threadedly engaged with the base (22), the base (22) is brought into contact with and fixed to the sound board (c1) such that a spherical projecting portion (23) abuts against the back surface of the cast-iron plate (b1) from the central portion of the upper surface of the sensor member (1), and by rotating the long screw (11), the pickup apparatus body (D) having the sound board (c1) can be allowed to be tightly interposed between the sound board (c1) and the cast-iron plate (b1).

Figure 10:
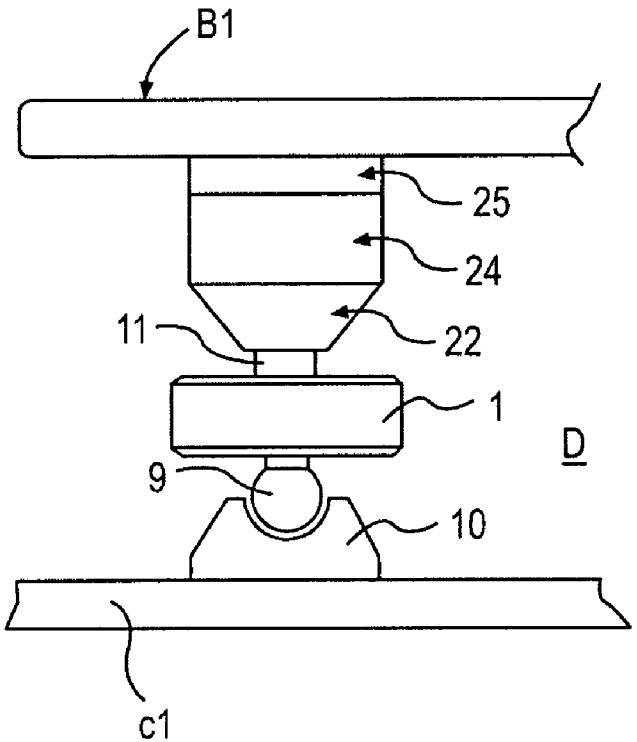
FIG. 10 is a partially cut-away front explanatory view of a seventh embodiment.

FIG. 10 shows an example of a viscoelastic member (7) (mechanical vibration filter) which eliminates vibration of noise portions (vibration transmitted from a floor, vibration generated when a pedal of a pedal is operated and the like) which is unnecessary for piano sound coming from a portion which is not vibrated (stationary member (B) or the like) to the pickup apparatus body (D) of the present invention.

That is, a mass (24) and a viscoelastic body (25) are placed on the base (22) of the fifth embodiment (FIG. 8) explained above, and this is engaged with the back surface of the cast-iron plate (b1).

In this case, the viscoelastic body (25) has both spring characteristics and viscous characteristics, and if the viscoelastic body (25) is pushed slowly, this acts as a spring (at low frequency), and if the viscoelastic body (25) is pushed quickly, this becomes a hard solid object (at high frequency). To be precise, the viscoelastic body (25) exhibits viscous drag. By sandwiching the viscoelastic body (25) between the cast-iron plate (b1) and the mass (24), vibration force of low frequency is absorbed by the spring characteristics and the mass (24) and is not allowed to pass through, and vibration of high frequency passes through because the viscoelastic body (25) is hard and thus, the vibration force of high frequency is introduced to the sensor member (1). With this effect, noise component of low frequency is not pickup.

Figure 11:
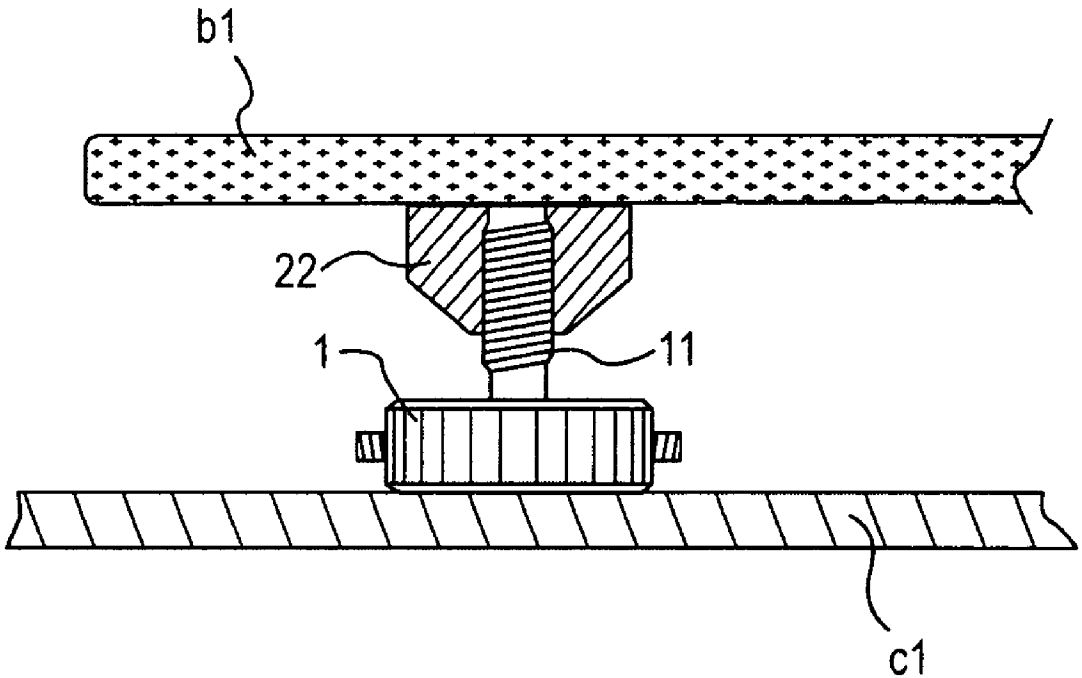
FIG. 11 is a partially cut-away front explanatory view of an eighth embodiment.

An embodiment shown in FIG. 11 is an example in which the angle adjusting mechanism (5) of the previous embodiment is unnecessary and in this case, the sensor member (1) is placed directly on the upper surface of the sound board (c1).

In any of embodiments shown in FIGS. 12 to 15, the pickup apparatus body (D) of the present invention is provided such as to be in contact with a ponticello (c3) of a string of a bridge (c5) provided on the sound board (c1).

Figure 12:
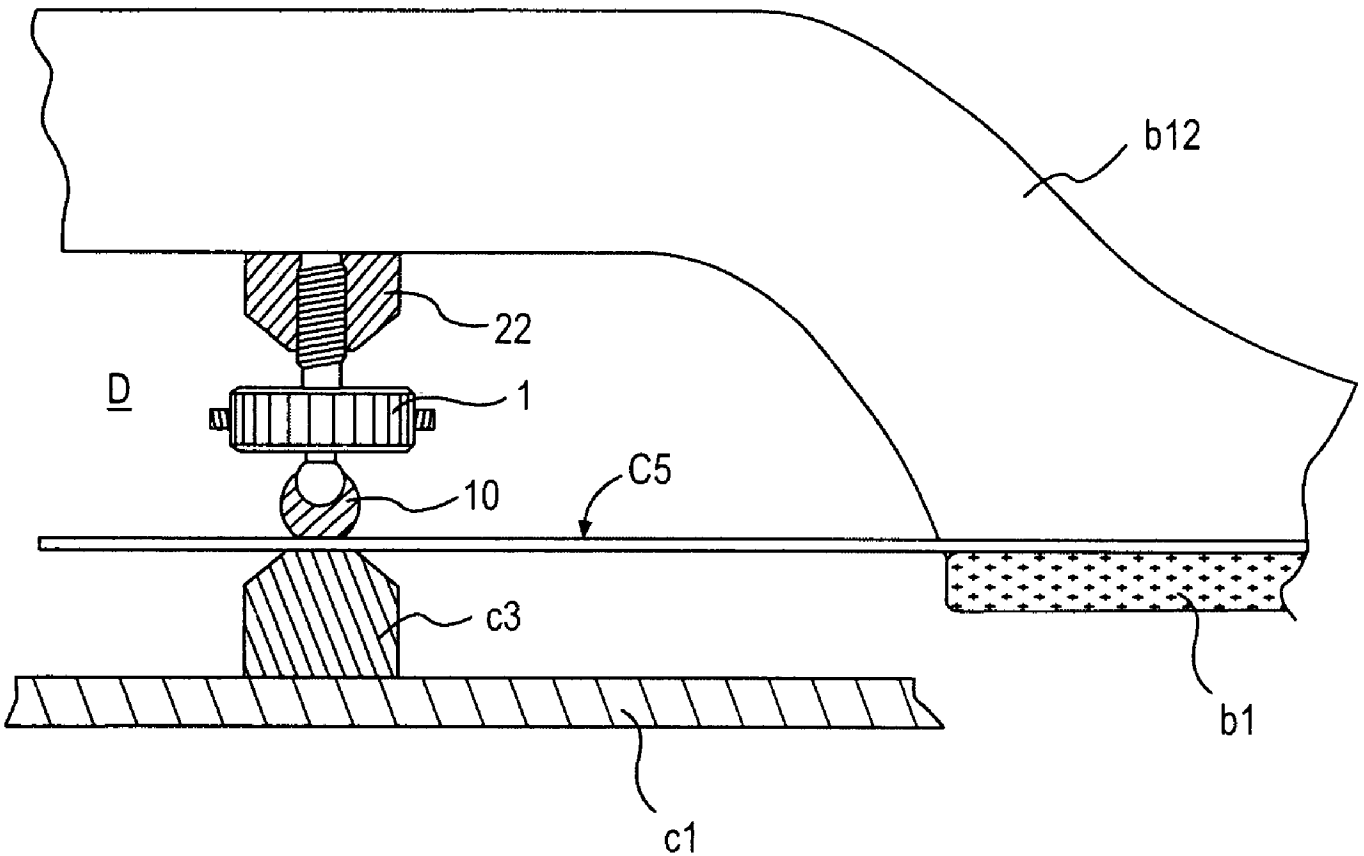
FIG. 12 is a partially cut-away front explanatory view of a ninth embodiment.

In FIG. 12, the pickup apparatus body (D) has the same structure as that of the fifth embodiment (FIG. 8). In this case, the supporting body (10) is in contact with an upper surface of the bridge through the string (c5), and the base (22) is in contact with a lower surface of the arm (b12) of the cast-iron plate (b1).

Figure 13:
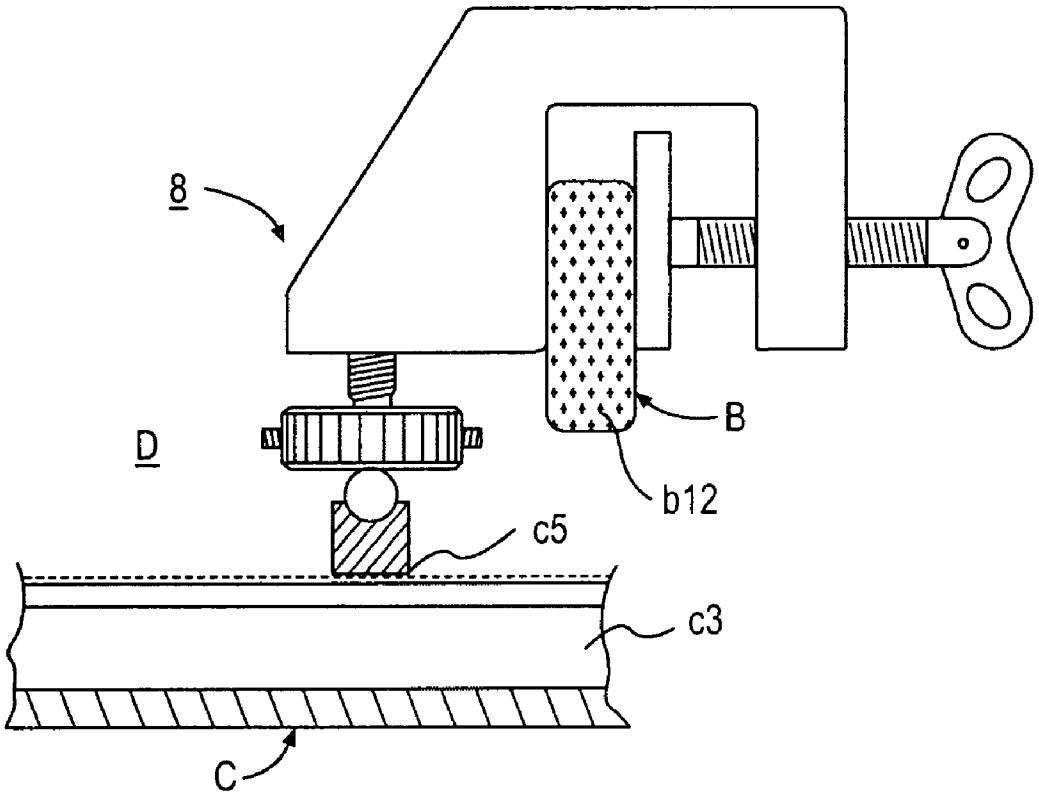
FIG. 13 is a partially cut-away front explanatory view of a tenth embodiment.
Figure 14:
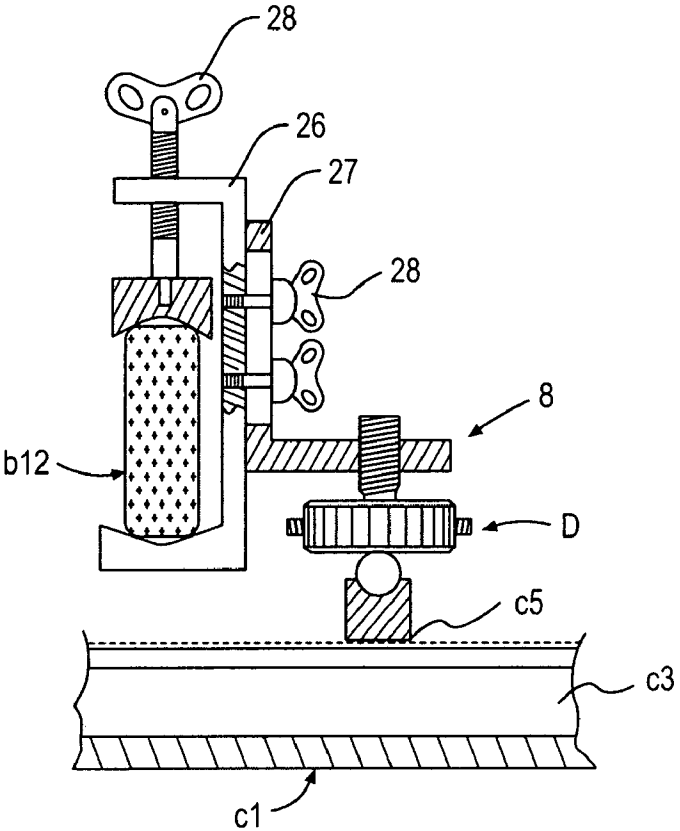
FIG. 14 is a partially cut-away front explanatory view of an eleventh embodiment.

FIGS. 13 and 14 show examples in which the above-described mounting member (8) is provided.

That is, in FIG. 13, a vise-like mounting member (8) exclusive to this embodiment is provided such as to sandwich the arm (b12) of the cast-iron plate (b1), and the first contact member (2) of the pickup apparatus body (D) of the present invention is abutted against the mounting member (8).

That is, this mounting member (8) may not be provided in single, but several kinds of members may be combined. FIG. 14 shows a structure in which the mounting member (8) comprises a member (26) having U-shape cross section and an L-shaped member (27) provided along a vertical outer surface of the U-shaped member (26), the U-shaped member (26) fixes the arm (b12) of the cast-iron plate by a screw (28), and the L-shaped member (27) is fixed to an appropriate position of the U-shaped member (26) by the screw (28), and the L-shaped member (27) is threadedly engaged with the long screw (11) of the pickup apparatus body (D).

Figure 15:
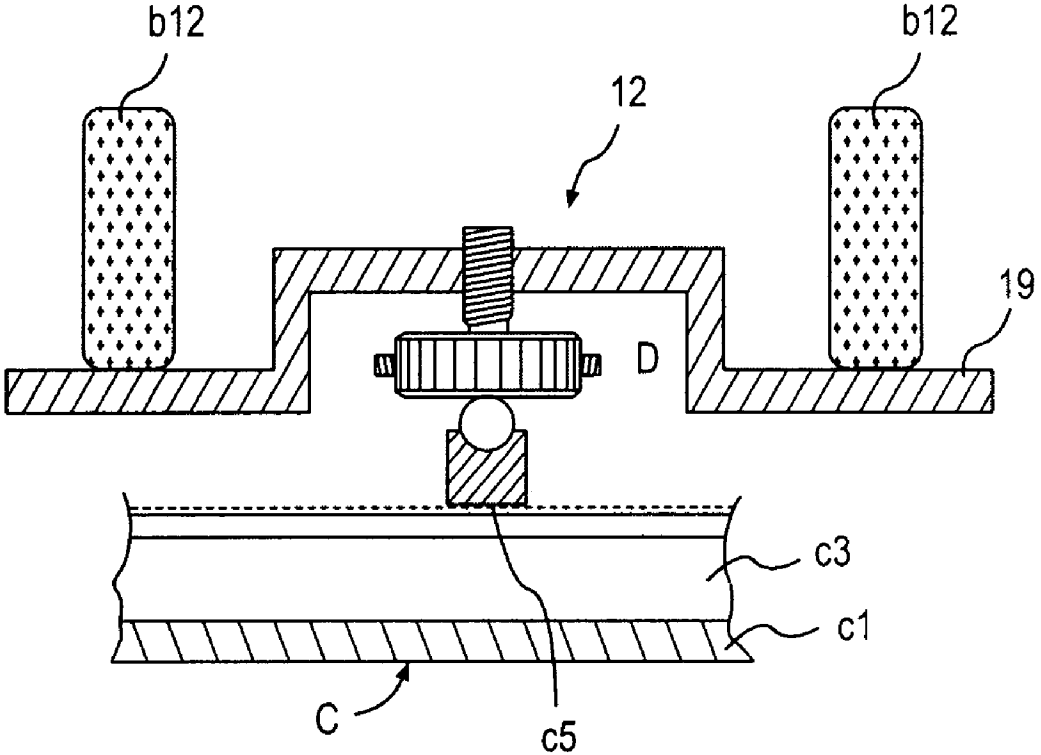
FIG. 15 is a partially cut-away front explanatory view of a twelfth embodiment.

FIG. 15 shows a structure corresponding to that of the third embodiment (FIG. 6) except that the position where the piano body is mounted is changed. That is, the arms (b12) of the cast-iron plate (b1) have portions which are opposed to each other at a constant distance, and when the piano body is placed in such portions, it may be disposed such that the lower surfaces of the arms (b12) are in contact with both the shoulder portions (19) of the main arm (12). The pickup apparatus body (D) of the present invention can be placed on any place only if it is interposed between the stationary member (B) and the sound source member (C) of the piano body (A).

Figure 16:
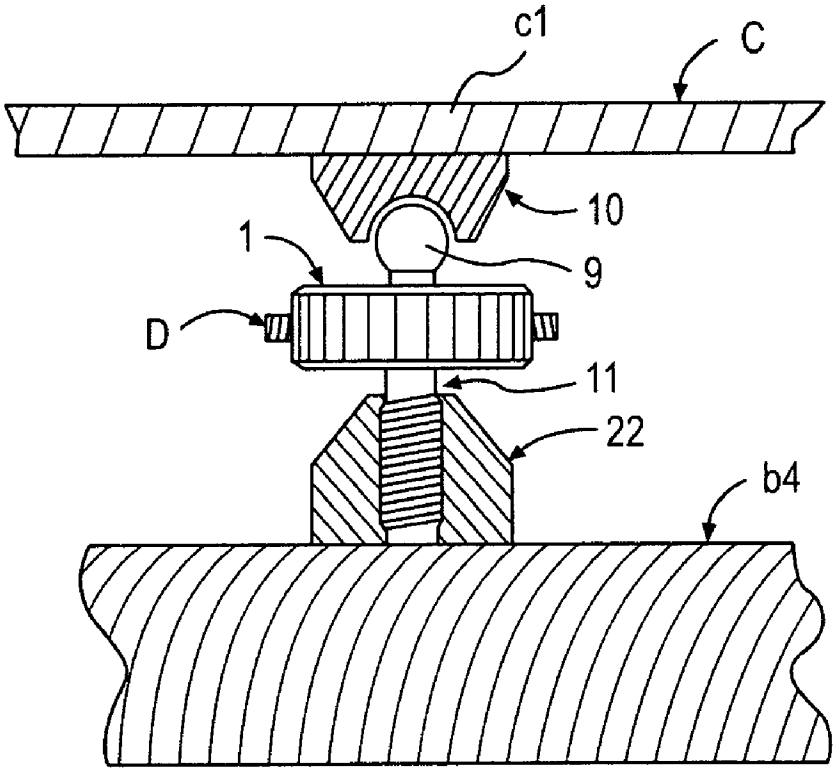
FIG. 16 is a partially cut-away front explanatory view of a thirteenth embodiment.
Figure 17:
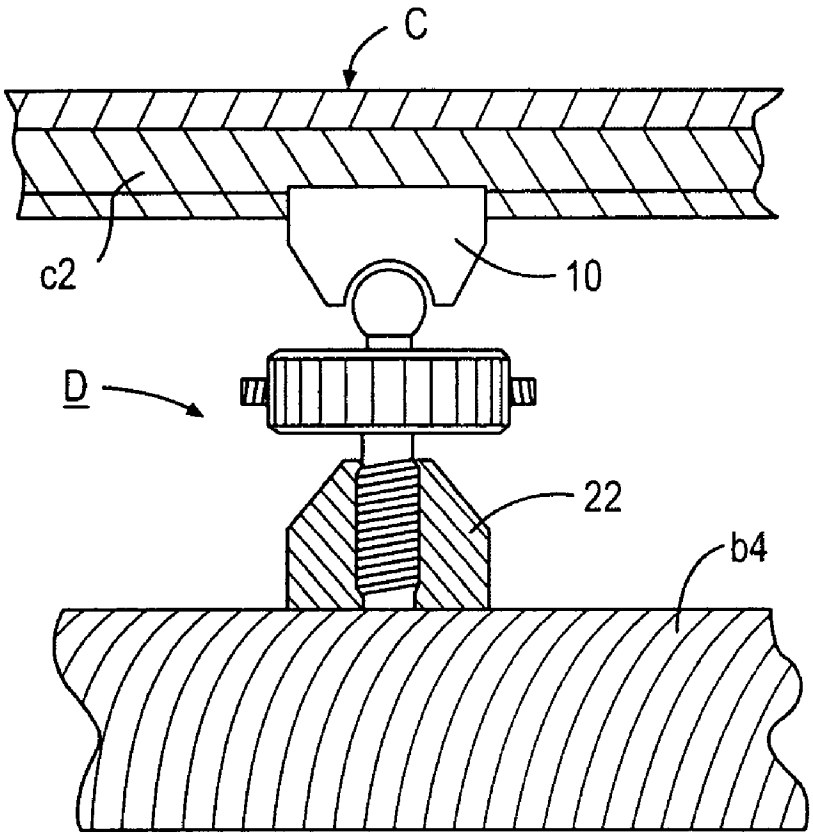
FIG. 17 is a partially cut-away front explanatory view of another structure of the thirteenth embodiment.
Figure 18:
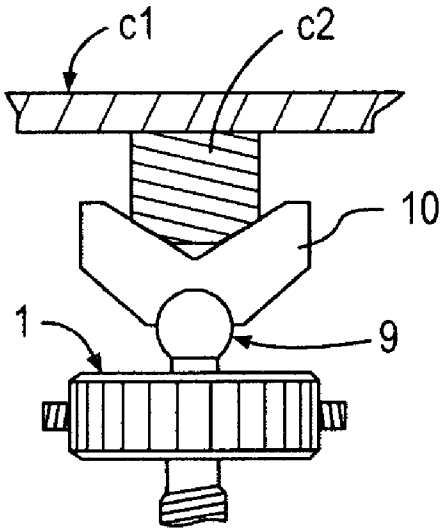
FIG. 18 is a partially cut-away side explanatory view of FIG. 17.

That is, in FIG. 16, the pickup apparatus body (D) is provided between a brace (b4) of the piano body (A) and the sound board (C), and in FIGS. 17 and 18, the pickup apparatus body (D) is provided between the brace (b4) and a rib (c2) adhered to the sound board (c1).

Figure 19:
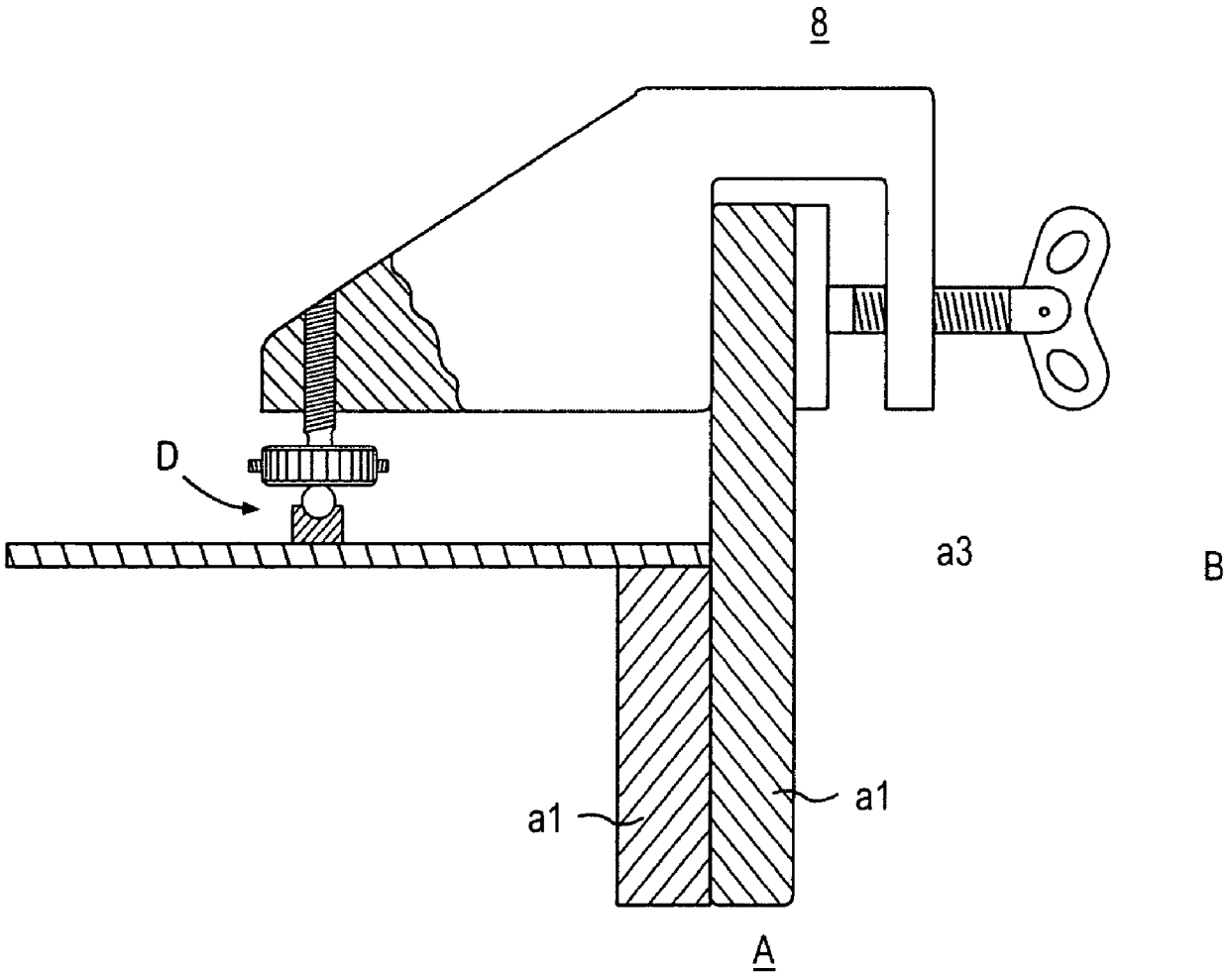
FIG. 19 is a partially cut-away front explanatory view of a fourteenth embodiment.

In FIG. 19, the pickup apparatus body (D) is provided between the case body (a1) constituting the piano body and the sound board (c1), and its structure is the same as that of the fifth embodiment (FIG. 8).

Although the present invention has been fully described in connection with the preferred embodiment thereof with reference to the accompanying drawings, it is to be noted that various changes and modifications will be apparent to those skilled in the art. Such changes and modifications are to be understood as included within the scope of the present invention as defined by the appended claims, unless they depart therefrom.

EXPLANATION OF SYMBOLS

A piano body
a1 case
a2 beam member
a3 various reinforcing member
B stationary member
b1 cast-iron plate
b11 hole
b12 arm
b2 pin block
b3 back post (vertical piano)
b4 brace
b5 inner rim
b6 outer rim
C sound member
c1 sound board
c2 rim
c3 bridge
c4 bridge pin
c5 string
D pickup apparatus body
1 sensor member
2 first contact member
3 second contact member
4 length adjusting mechanism

5 angle adjusting mechanism
6 electric output connector member
7 viscoelastic member
8 mounting member
9 spherical body
10 supporting body
11 long screw
12 main arm
13 sub-arm
14 screwed
15 contact member
16 rotation knob
17 output connector
18 J-shaped sub-arm
19 opposite shoulder portions
20 L-shaped sub-arm
21 through groove
22 base
23 spherical projecting portion
24 mass
25 viscoelastic member
26 U-shaped member
27 L-shaped member
28 screw

What is claimed is:

1. A pickup apparatus of a piano having a stationary member and a sound source member which vibrates according to a sound of the piano, comprising:

a sensor for detecting a vibration of said sound source member and a rigid sensor holding member which contacts said stationary member and said sound source member, and rigidly keeps said sensor between said stationary member and said sound source member, wherein said rigid sensor holding member has a length adjusting mechanism for rigidly adjusting a length of said sensor holding member, according to a distance between said stationary member and said sound source member, said sensor is forcibly and rigidly supported and held between said stationary member and said sound source member, upon adjustment of said length adjusting mechanism, so that a first side end of said sensor holding member contacts a stationary member side and a second side end contacts a sound source member side, and said first side end or second side end has an angle-adjusting mechanism contacting said stationery member or said sound source member such that said sensor is rigidly supported and held by said sensor holding member at an arbitrary angle between said stationery member and said sound source member, so as to optimize detection of vibration from said sound source member at the sensor.

2. A pickup apparatus of a piano according to claim 1, wherein the sensor of the sensor holding member comprises a piezoelectric force pickup.

3. A pickup apparatus for a piano according to claim 1, wherein the length adjusting mechanism comprises:

a screw portion extending along a length direction of said rigid sensor holding member; and a receiving portion contacting said stationery member or said sound source member, having threads for accepting and engaging with the screw portion, wherein a rotation of said rigid sensor holding member rigidly adjusts the length of the sensor holding member, in a direction substantially perpendicular to said rotation.

4. A pickup apparatus for a piano according to claim 3, further comprising at least two detachable electric signal output connectors, spaced apart on said rigid sensor holding member, such that the rotation of said sensor holding member rotates at least one of said output connectors to a conveniently accessible position.

5. A pickup apparatus for a piano according to claim 1, wherein said apparatus is mounted in a grand piano.

6. A pickup apparatus for a piano according to claim 1, wherein said apparatus is mounted in an upright or vertical piano.

7. A pickup apparatus for a piano according to claim 1, wherein said angle-adjusting mechanism includes a supporting member contacting said stationery member or said sound source member, said supporting member having a hollow for rotatably receiving a spherical portion of said rigid sensor holding member, wherein said length adjustment fixes said spherical portion to said supporting member at said arbitrary angle.

8. A pickup apparatus for a piano according to claim 1, wherein when the angle adjusting mechanism is disposed at one of said first side end or said second side end, the length adjusting mechanism is disposed at a respective other side end.

9. A pickup apparatus of a piano having a stationary member and a sound source member which vibrates according to a sound of the piano, comprising:

a sensor for detecting a vibration of said sound source member and a rigid sensor holding member which contacts said stationary member and said sound source member, and rigidly keeps said sensor between said stationary member and said sound source member, wherein said rigid sensor holding member has a length adjusting mechanism for rigidly adjusting a length of said sensor holding member, according to a distance between said stationary member and said sound source member, said length adjusting mechanism further comprising:

a screw portion extending along a length direction of said rigid sensor holding member; and a receiving portion contacting said stationery member or said sound source member, having threads for accepting and engaging with the screw portion, wherein a rotation of said rigid sensor holding member rigidly adjusts the length of the sensor holding member, in a direction substantially perpendicular to said rotation, and further wherein said sensor is forcibly and rigidly supported and held between said stationary member and said sound source member, upon adjustment of said length adjusting mechanism, so that a first side end of said sensor holding member contacts a stationary member side and a second side end contacts a sound source member side, and said first side end or second side end has an angle-adjusting mechanism contacting said stationery member or said sound source member such that said sensor is rigidly supported and held by said sensor holding member at an arbitrary angle between said stationery member and said sound source member, so as to optimize detection of vibration from said sound source member at the sensor, said angle-adjusting mechanism further comprising:

a supporting member contacting said stationery member or said sound source member, said supporting member having a hollow for rotatably receiving a spherical portion of said rigid sensor holding member, wherein said rotation of said sensor holding member for length adjustment fixes said spherical portion to said supporting member at said arbitrary angle.

10. A pickup apparatus for a piano according to claim 9, wherein when the angle adjusting mechanism is disposed at one of said first side end or said second side end, the length adjusting mechanism is disposed at the remaining side end.

11. A pickup apparatus for a piano according to claim 9, further comprising at least two detachable electric signal output connectors, spaced apart on said rigid sensor holding member, such that the rotation of said sensor holding member rotates at least one of said output connectors to a conveniently accessible position.

* * * * *